US007112733B1

(12) United States Patent
Babicz

(10) Patent No.: US 7,112,733 B1
(45) Date of Patent: Sep. 26, 2006

(54) STRING INSTRUMENT

(76) Inventor: Jeffrey T. Babicz, 46 Fletcher Dr., Newburgh, NY (US) 12550

( * ) Notice: Subject to any disclaimer, the term of this patent is extended or adjusted under 35 U.S.C. 154(b) by 0 days.

(21) Appl. No.: 10/816,478

(22) Filed: Apr. 1, 2004

Related U.S. Application Data

(60) Provisional application No. 60/490,991, filed on Jul. 30, 2003.

(51) Int. Cl.
*G10D 3/04* (2006.01)

(52) U.S. Cl. ..... 84/298; 84/299; 84/297 R

(58) Field of Classification Search ..... 84/297 R, 84/298, 259, 300–302, 290
See application file for complete search history.

(56) References Cited

U.S. PATENT DOCUMENTS

| | | | | |
|---|---|---|---|---|
| 2,216,601 | A | 10/1940 | Nelson | |
| 3,174,380 | A | 3/1965 | Cookerly | |
| 3,204,510 | A | 9/1965 | Hopf | |
| D224,154 | S | 7/1972 | Gilbert | |
| 4,135,426 | A | 1/1979 | Rickard | |
| 4,334,454 | A | 6/1982 | Wall | |
| 4,385,543 | A | 5/1983 | Shaw | |
| 4,425,832 | A | 1/1984 | Peavey | |
| 4,432,267 | A | 2/1984 | Feller | |
| 4,464,970 | A | 8/1984 | Mischakoff | |
| 4,625,613 | A | 12/1986 | Steinberger | |
| D293,331 | S | 12/1987 | Erlewine | |
| 4,951,543 | A * | 8/1990 | Cipriani | 84/298 |
| 4,960,027 | A | 10/1990 | Dunwoodie | |
| 5,052,260 | A | 10/1991 | Cipriani | |
| 5,092,213 | A | 3/1992 | Cipriani | |
| 5,208,410 | A | 5/1993 | Foley | |
| 5,448,935 | A | 9/1995 | Kosinar | |
| 5,549,027 | A | 8/1996 | Steinberger | |
| 5,600,078 | A | 2/1997 | Edwards | |
| 5,627,331 | A | 5/1997 | Devitrysmith | |
| 5,679,910 | A | 10/1997 | Steinberger | |
| 5,686,677 | A * | 11/1997 | Herbert | 84/307 |
| 6,051,766 | A | 4/2000 | Taylor | |
| 6,265,648 | B1 | 7/2001 | Steinberger | |
| 6,297,434 | B1 | 10/2001 | Martello | |
| 6,372,971 | B1 * | 4/2002 | Rogers | 84/298 |

* cited by examiner

*Primary Examiner*—Kimberly Lockett
(74) *Attorney, Agent, or Firm*—Joseph L. Spiegel; Heslin, Rothenberg, Farley and Mesiti, P.C.

(57) ABSTRACT

A stringed musical instrument, such as a guitar, whereby the lower end of the strings are anchored to the soundboard itself with one or more of the string anchors being positioned past the bridge. This arrangement provides an offset of the lateral compressive forces to the entire soundboard, therefore allowing the soundboard to vibrate more freely in response to the string vibration, and creating an acoustical perpetuating effect. Due to the inherent strength to this design, internal soundboard bracing can be minimized in weight and size as well, which offers a fuller and louder sound, with an increase in sonic balance and sustain.

6 Claims, 10 Drawing Sheets

STRING INSTRUMENT

CROSS REFERENCE TO RELATED APPLICATIONS

Provisional application No. 60/490,991 filed on Jul. 30, 2003.

BACKGROUND OF INVENTION

1. Field of the Invention

This invention relates to a string instrument and more particularly to an acoustic guitar.

2. Description of the Related Art

The design of modern acoustical guitars has remained relatively unchanged for many years. A traditional acoustic guitar features a hollow body which has a top, sides and back thus forming a sound chamber. The hollow body is connected to a neck. The guitar has a plurality of strings strung at a substantial tension extending from the neck across the top of the hollow guitar body and is then fixably secured to a bridge body which is attached to a bridge plate that is secured to the top of the guitar body. The top of the hollow guitar body is referred to as the soundboard and the recess in the top of the guitar body is called the soundhole. In order to provide superior acoustic performance, the soundboard must be capable of sufficient vibration so that it can resonate freely and produce a true tone. Therefore, the soundboard is usually constructed from woods that provide superior tonal characteristics and have a high strength to weight ratio such as spruce or cedar wood.

The bridge is typically made from hardwood such as rosewood or ebony that is affixed to the nominal center of the instrument soundboard, directly above the bridge plate. The bridge contains a saddle, which is usually a long thin blade made of a harder material than the bridge itself, such as bone, ivory, shell, etc. The saddle is recessed into the bridge and it acts as a firm contact point for the strings.

In traditional acoustic guitars, bridge pins anchor the ends of the strings in position and are passed through the bridge, behind the saddle via tapered holes that pass through the bridge plate, which lies under the soundboard directly below the bridge. Bridge-pin style bridges have been used for centuries and are considered the industry standard for most steel strung instruments. The disadvantage with bridge pins is that they are structurally invasive to the bridge itself, and over time the bridge can split parallel to the bridge pin holes. Bridge pins are also unreliable over time because the bridge pinholes have the potential to wear after the player has re-strung the instrument numerous times. The wear on the bridge pinholes compromises the frictional fit of the pin to bridge, allowing the possibility of the pin and/or string to disengage from the bridge.

The bridge plate is usually a thin piece of hardwood; such as maple, ebony or rosewood. It is necessary for the bridge plate to be extremely hard in order to withstand the pull of the ball end of the strings.

String anchors are typically mounted to a bridge body or another structure that is attached to the top of the guitar. When the musical instrument strings are plucked, a significant amount of the energy is passed to the string anchors. In order to maximize the energy transmitted to the guitar top it is desirable to place the string anchors on the soundboard as opposed to the bridge body. The placement of the string anchors on the soundboard increases the efficiency that the string vibrations are transferred to the soundboard.

A major obstacle to maintaining the stability of an acoustic stringed musical instrument over time is caused by the large degree of tensile forces placed on the guitar top in a lateral and semi-vertical manner once the strings are tightened to pitch. The strings exert tension on the soundboard behind the bridge and compression in front of the bridge. The overall tensile forces on the instrument's soundboard can be upwards of 150–190 pounds on a six-string guitar and over 400 pounds of string pull on a 12-string steel strung guitar. The tensile forces of the strings on the guitar top can cause the structure of the guitar body to deform. For instance, a traditional guitar top may become arched or "bellied" behind the bridge and concave in front of the bridge due to the tensile forces of the strings. The forces exerted by the strings also produce a forward twisting torque on the bridge. Over time this torque will pull the bridge forward, creating a de-lamination of the bridge-to-soundboard bond and raising the string height drastically. In many cases the instrument is rendered unplayable due to the damage caused by the tensile forces created by the strings.

To maintain the structural integrity of the guitar top, a traditional guitar must be reinforced with braces. One of the most popular methods of soundboard reinforcement bracing is the use of an "X" pattern, which was developed by the C.F. Martin Co. in the 1840's. The "X" bracing pattern and its variants are now used by most major acoustic guitar manufactures today. Generally, heavy bracing will have a detrimental affect on the acoustic performance of the instrument. In most cases, substantial bracing will mute the acoustic properties of the instrument. Therefore, it is desired to have light bracing for the instrument's soundboard in order to provide the best acoustic performance. The challenge of the instrument builder is to provide enough bracing to the soundboard in order to minimize warping of the soundboard, while ensuring an optimal acoustic performance from the soundboard.

The acoustic performance of a guitar is affected greatly by the amount of tensile force exerted on the soundboard of the instrument. Generally, a certain degree of tensile energy is needed for the soundboard to have an optimal response to the strumming of the strings. If there is no tensile force placed on the soundboard, the energy caused by the vibrations of the string is absorbed and the acoustic projection and sustain of the resulting sound becomes diminished. With a proper amount of tensile force placed on the soundboard, there is an increased movement of the soundboard surface in response to the vibration of the strings. The projection, sustain and tone of the instrument is greater when there is an increase in the movement of the soundboard surface in response to the vibration of the strings.

For instance, many flattop acoustic guitars, archtop guitars, and classical instruments, such as violins and cellos, contain tailpieces on the butt end of the instrument. The tailpieces absorb virtually all of the tensile forces created by the strings. Consequently, bracing on the soundboard of an instrument that contains a tailpiece can be quite light. On flat top steel string guitars, only a trace amount of tensile force can exist in the soundboard of the instrument. Consequently, acoustic projection and sustain with this type of instrument is diminished. Furthermore, a tonal imbalance can be created up and down the neck.

Just as too little tensile energy on the soundboard can have detrimental effects on the instrument's acoustic performance, too much tensile force on the instrument's soundboard will impede the soundboard's ability to move in response to the energy caused by the vibration of the strings. Consequently, too much tensile forces on the soundboard will dampen the vibrations of the resonance body, decrease the volume of the sound produced by the instrument, and affect the distinctive tonal properties of the instrument.

Over the years luthiers have developed alternate designs to provide a musical instrument that reduces or eliminates the need for soundboard bracing while still having superior acoustical performance. For example, U.S. Pat. No. 5,025,695 discloses a design for a string instrument wherein the strings are attached to the neck at the strings upper and lower ends. Since the strings are secured directly on the instrument neck, the tensile forces that the strings normally exert on the instrument's soundboard in a traditional acoustic guitar are instead directed mainly on the instrument's neck. While the need for bracing of the soundboard is greatly reduced on this type of guitar construction, this design allows virtually no tensile forces to exist in the instrument's soundboard. Consequently, the soundboard does not have enough tensile force to allow for an optimal acoustic performance by the instrument. The limitations on the soundhole design decreases the fullness of the acoustic tone produced by the instrument and increases the risk of damage to the guitar by placing a large amount of tensile force on the neck which normally has a less secure structure than the body of the guitar.

Another example of a musical instrument which decreases the forces on the soundboard of a stringed musical instrument without compromising the stability of the instrument is disclosed in U.S. Pat. No. 5,549,027. This patent concerns a bridge design that has two contact points that are equal in vertical height above the guitar body as the upper string contact point on the instrument neck. The two contact points in the bridge are displaced either horizontally or vertically in order to neutralize some of the forces exerted by the strings and to direct the force onto the bridge. The disadvantage with this construction is that the soundboard does not have enough tensile force to provide optimal projection, tone and sustain. Further, the bridge design is complicated and is subject to damage by the tensile forces. Additionally, a significant amount of the energy created by the strings is absorbed by the bridge body and is not transmitted to the resulting sound produced by the instrument. Another disadvantage is that the distance between the strings and fingerboard of the instrument, known as the "action," may be undesirable to the instrument player because the string must be at the same vertical height from the neck to the bridge. In order to make adjustments in the action the disclosed patent requires the player to make complicated adjustments by inserting shims between the neck assembly of the musical instrument. This type of adjustment is inefficient and imprecise and the user must have a significant amount of time and skill in order to make these adjustments properly.

SUMMARY OF INVENTION

The present invention is based on the ends of the strings of the instrument that are used for playing being anchored to the soundboard itself with one or more of the string anchors being positioned past the bridge. The preferred design has one or more of the strings anchored near the outside edge of the lower bout of the instrument. In one embodiment the strings are anchored in an arrangement past the bridge so that it is spread across the soundboard in a fan-like or radial pattern. This arrangement provides an offset of the lateral compressive forces and an even string load pull displaced towards the lower bout of the guitar top.

In the current invention, the path of the strings begins where it is attached to string anchors that are attached to the soundboard with one or more of the string anchors positioned below the bridge. In a preferred embodiment, the guitar features the use of a split bridge design, which is adjustable for intonation. The split bridge has two primary parts—the bridge itself which has the string contacting saddle and the string retainer. The strings are passed through the string retainer before reaching the bridge saddle which provides a contact point to fixably secure the strings. The strings then extend to the neck where they are attached to tuning pegs located on the headstock.

With the strings tuned to pitch, the tensile forces created by the strings are concentrated near the edges of the top of the guitar and there is an offset of lateral compressive forces to the entire soundboard. Consequently, minimal bracing is need in order to maintain the structural integrity of the instrument soundboard. An optimal amount of tensile force for the acoustical performance of the instrument exists within the resonating soundboard. This tensile energy allows the soundboard to vibrate more freely in response to the string vibration and creates an acoustical perpetuating effect which provides a fuller, louder sound, with improved tonal balance and increased sustain.

In another embodiment, the action of the instrument can be adjusted by having an adjustable neck as part of the instrument. In the preferred embodiment, the neck is adjustable vertically without changing the angle of the neck relative to the body. This allows the user the ability to adjust the action for further customization of the instrument playability.

Furthermore, through the use of the split bridge design, the undesired effect of a rotational torque, such as on traditional bridge-pin designs, is significantly reduced by directing the strings through the retainer first, which is fastened to the top of the instrument, then across the bridge's saddle. Through this method, the forward rotational torque effect is negated by the vertical pull of the string retainer, and vertical downward push of the saddle.

Additionally, the increased length between the instrument's upper and lower anchor points allows the string tension to be spread out a greater distance and the guitar strings are easier to depress as compared to a traditional guitar. The strings are easier to manipulate by the user and it allows for greater playability of the instrument.

Further, the bridge can be affixed to the instrument's top through the use of fasteners that pass through slots in the soundboard. The fasteners can be loosened (with the strings attached) and the bridge can be repositioned forward or backward to adjust the instrument's intonation, by making the scale length longer or shorter. This is most useful when the player changes string gauges, brands of strings, or string height, and a longer or shorter scale length is necessary for proper notation purity.

The strings can be anchored to the instrument top by various means. For instance, the strings can be anchored by traditional bridge pins which feature a recess to receive the string and a pin that fits into the recess in order to secure the string. In the preferred embodiment, the usage of a string anchor module replaces traditional bridge pins. The string anchor modules are attached directly to the top of the guitar body with a plate lying underneath. This design provides for greater resonance and a louder more full tone.

DETAILED DESCRIPTION OF THE INVENTION

Figure 1:
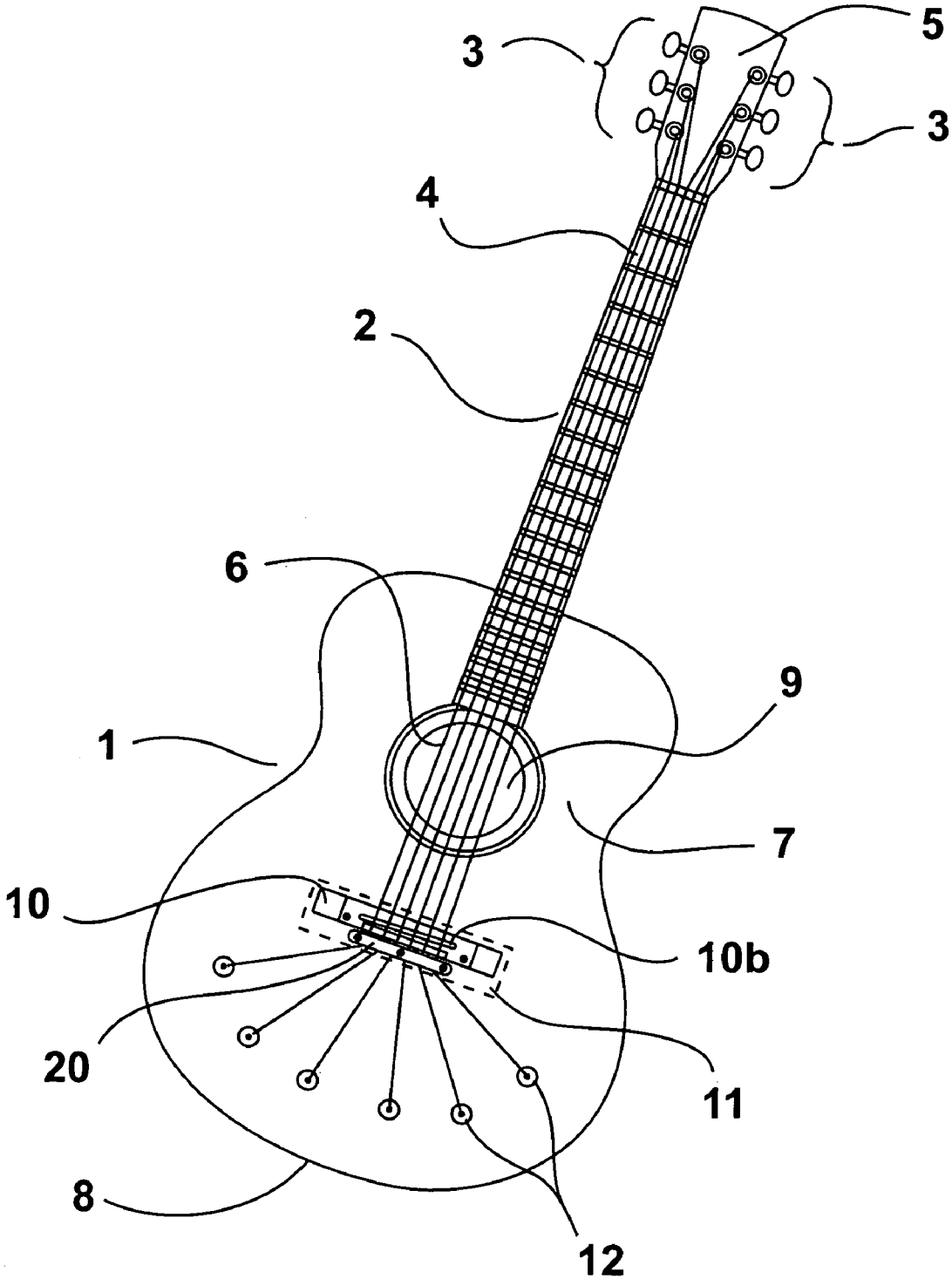
FIG. 1 is a frontal view of the string anchor invention on an acoustic six-string guitar.

For a more complete understanding of the invention, as well as other objects and further features thereof, reference may be had to the following detailed description of the invention in conjunction with the drawings wherein:

FIG. 1. shows a hollow body acoustic guitar 1 made preferably of wood, which is connected to a neck 2 assembly. The neck is made of wood or a related material, which is suitable to withstand continual string pull without warping or twisting. The neck has a headstock 5, which holds the tuning pegs 3, which in turn hold the strings 6. The strings are strung at a substantial tension and extend from the fixed point created at the guitar neck to the lower string contacting means. The neck is mated with a fretboard 4, which is made of a hard substance such as rosewood, ebony, or a re-enforced polymer. The material should be strong enough and stable enough to hold metal frets and withstand playing wear. The soundboard 7 which can be made of a known tonewood, such as spruce, cedar, mahogany, or other acoustically resonant materials such as wood laminates, plastic and/or metals or any combination of same.

The body 8 of the instrument consists of a soundboard, sides and back thus forming a sound chamber. The soundboard has a soundhole 9, which can be round, oval, or aesthetically shaped. A bridge plate 11 is attached underneath the soundboard and supports the bridge body 10. The bridge body 10 is made from a hardwood such as ebony, rosewood, or a suitable hard acoustically sound material. The bridge has a saddle 10*b* which provides a contact point to fixably secure the strings. The saddle is usually a long thin blade made of a harder material than the bridge itself, such as bone, ivory, or shell. A string retainer 20 is included, made from a hardwood such as ebony, rosewood, or a suitable material which has the proper structural nature to withstand the forces of steel string. The string retainer 20 guides each string from the lower string anchors 12 through the string retainer and to the saddle.

The instrument includes string anchors 12, which can be made from hardwood like the bridge or fabricated from metal or plastics, and can be bridge pin style. The bridge should be shaped not to interfere with playability and/or comfort. The bridge and string retainer can be fastened to the soundboard through the use of fasteners.

Figure 2:
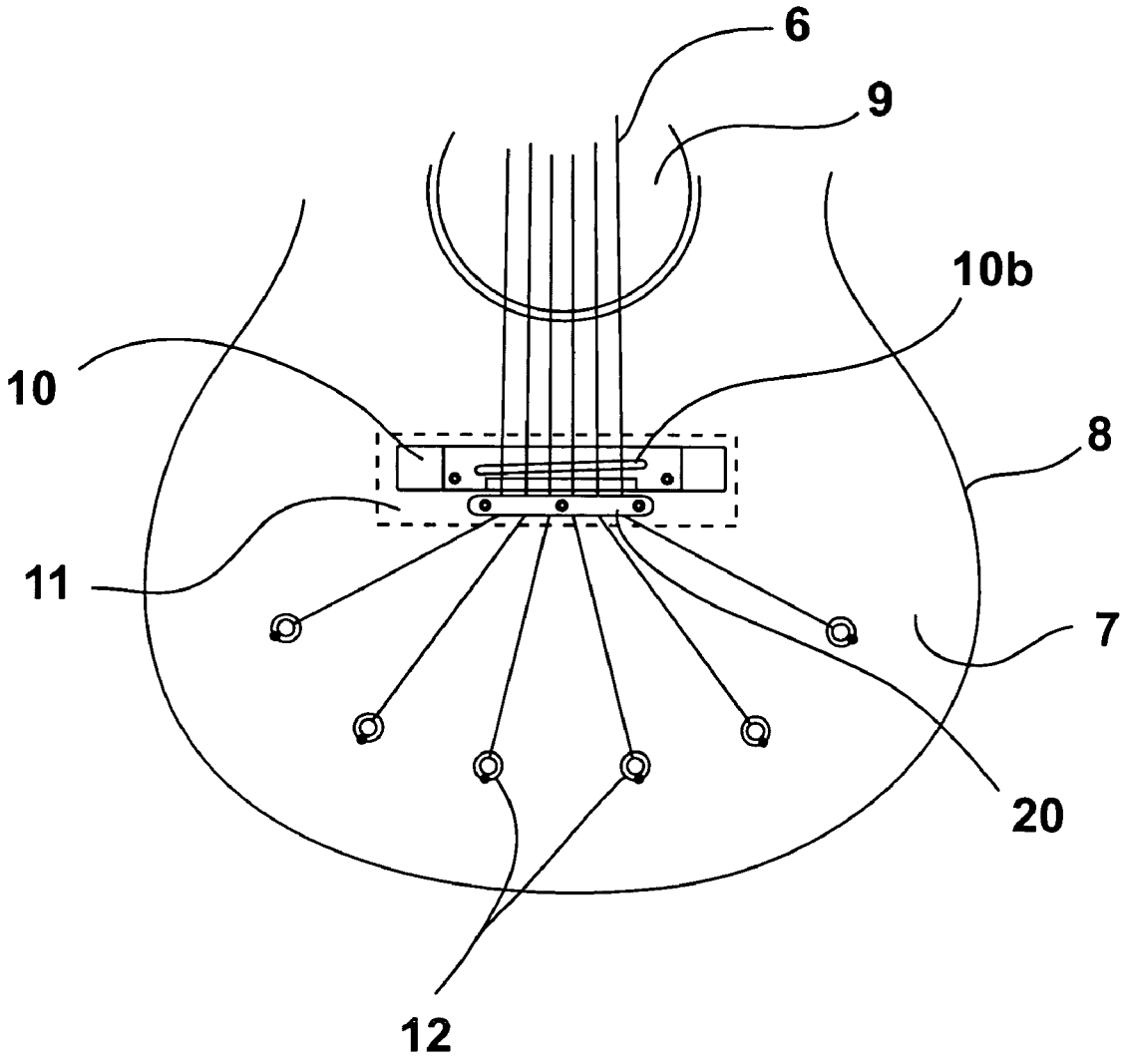
FIG. 2 is an exploded frontal view of the instrument detailing the string anchor and split bridge inventions.

FIG. 2 shows a close up view of the split bridge design and string anchors. The strings 6 are attached to string anchors 12. The preferred embodiment of the string anchor arrangement is shown as the string anchors are arranged in a fan-like or radial pattern. The strings 6 are passed through the string retainer 20 before reaching the bridge saddle 10*b* which provides a contact point to fixably secure the strings.

Figure 3:
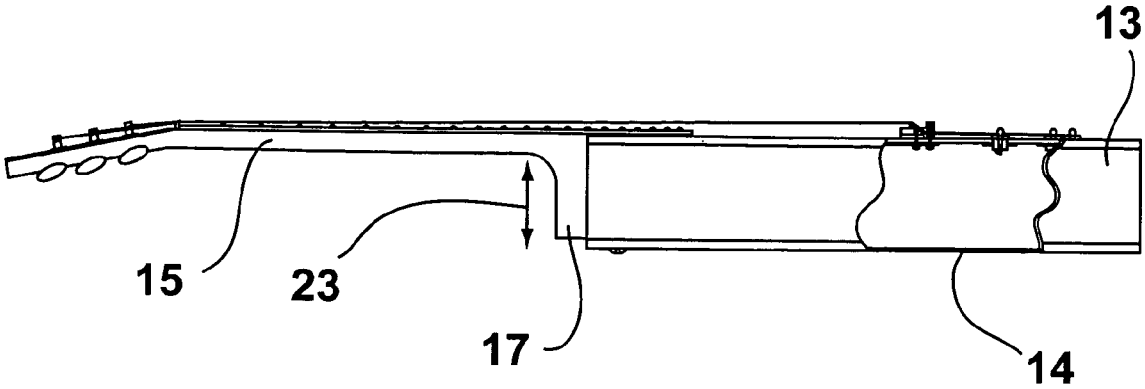
FIG. 3 is a side view of an acoustic guitar containing the string anchor invention.
Figure 4:
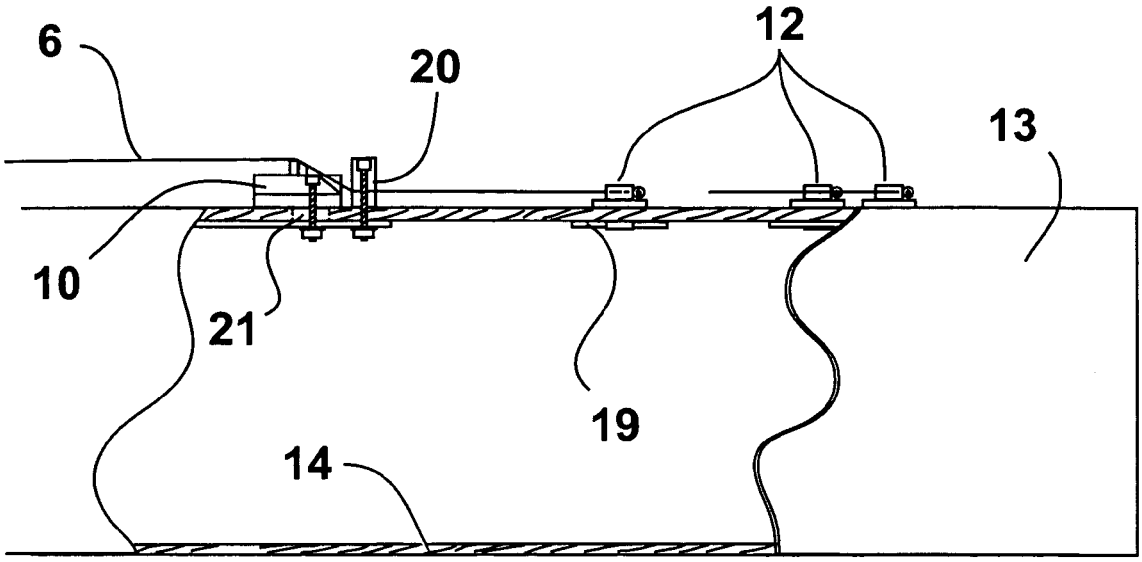
FIG. 4 is a close up side view of the string anchor invention
Figure 5:
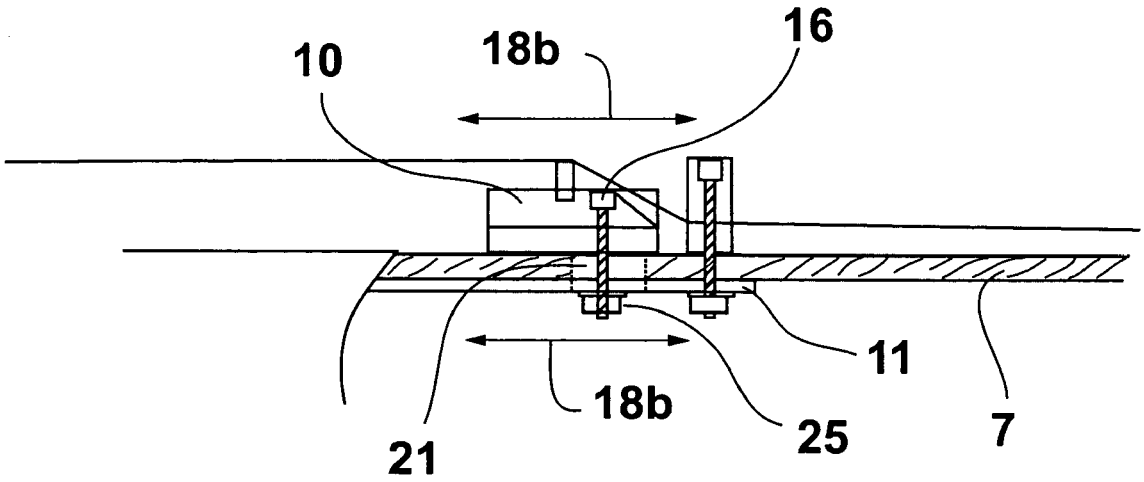
FIG. 5 is a close up side view of the adjustable bridge and string retainer device.

FIGS. 3–5 show the sides 13 and back 14 of the instrument, neck profile 15, which features a traditional 'heel' construction look 17, and cross section of string 6, bridge 10, string retainer 20, string anchors 12 and soundboard 7. The neck profile featuring a 'heel' 17 adds to the high quality appearance associated well constructed instruments. In the embodiment shown, the neck 2 is adjustable vertically 23 without changing the angle of the neck relative to the body. This allows the user the ability to adjust the action for further customization of the instrument playability.

The bridge body 10 is adjustable forward and backward for intonation integrity and in this embodiment is not glued to the soundboard. The sides and back material use industry known tonewood such as rosewood, mahogany, koa, maple and/or other suitable acoustically sound material.

The preferred embodiment for string retaining purposes consisting of a string anchor module 12 is shown attached to the soundboard through the use of string anchor fasteners 19. The fasteners can be of many different compositions, but are preferably made out of metal or plastic. The fastener passes through the soundboard secures the string anchor module in position via glue, fastener clip or a nut supported by a washer. In the shown embodiment, the string anchor fastener assembly 19 is glued to the soundboard. The string anchor module 12 retains the string because the horizontal hole passing through string anchor body is large enough to accept the string, yet small enough to prevent the string ball to pass through it.

Figure 6:
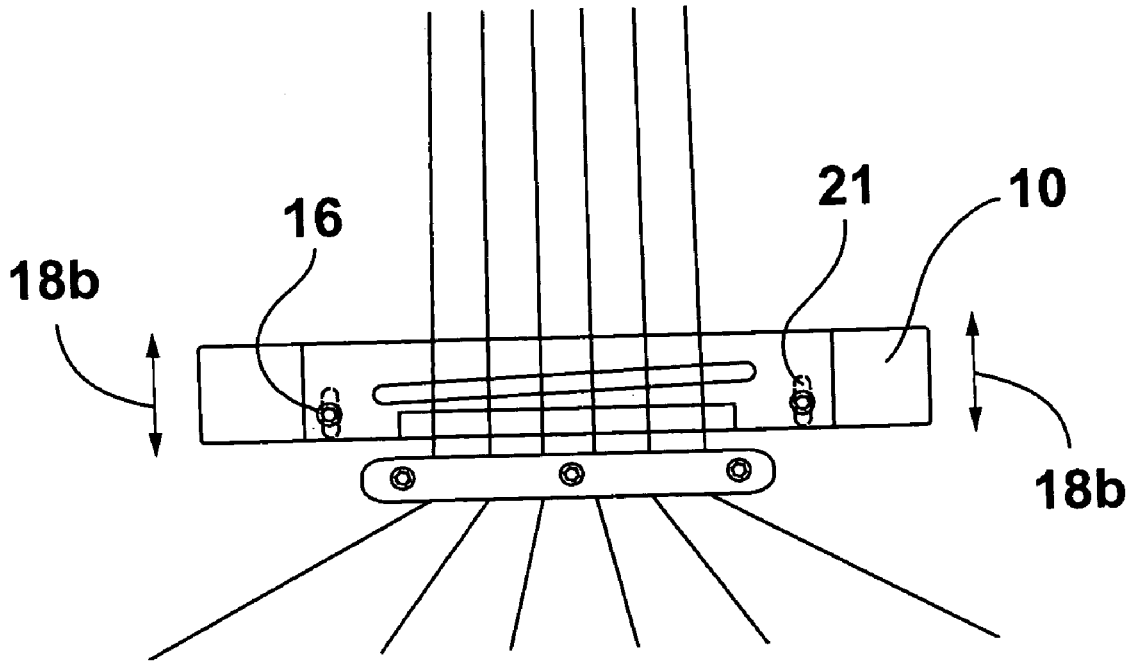
FIG. 6 is a close up frontal view of the adjustable bridge and string retainer device.

FIGS. 5–6 shows one embodiment of the split bridge design wherein the bridge body 10 is affixed to the instrument's top through the use of fasteners 16 that pass through slots 21 in the soundboard 7 and bridge plate 11. The fasteners allow the bridge body to be adjusted for intonation by sliding forward or backward 18-*b* to make the scale length longer or shorter. The fasteners can be of many different compositions, but are preferably made out of metal or plastic. Internally the nut portion of the fastener is such that an adjuster can slightly loosen the fastener, re-position the bridge and re-tighten the fastener/bridge without having to remove the strings, and/or enter the soundhole to hold the nut 25 in place while applying the proper fastening torque.

Figure 7:
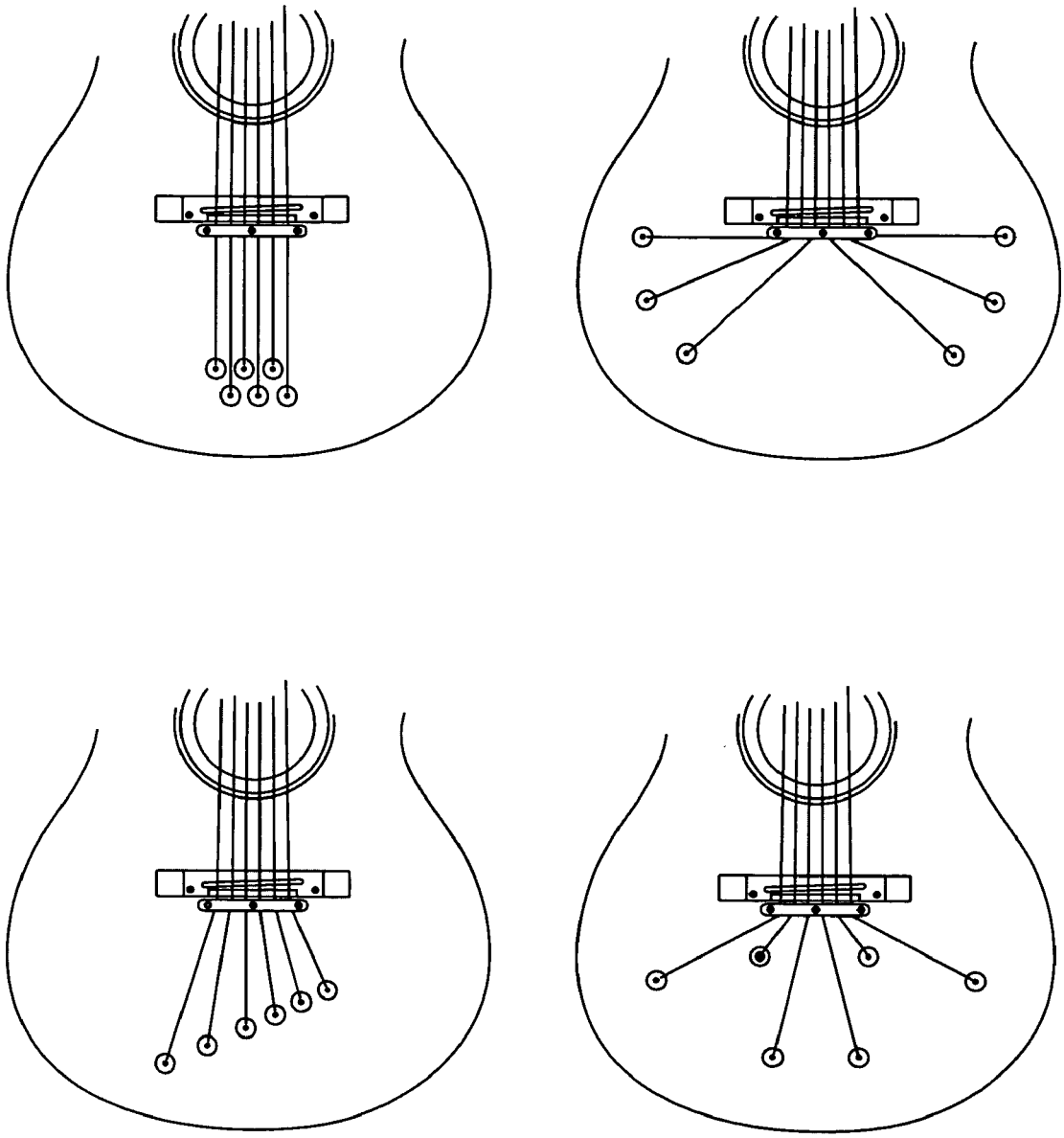
FIG. 7 is a frontal view of some of the many possible string anchor-to-soundboard mounting variations in the string anchor invention.

FIG. 7 details the possible limitless string anchor-to-soundboard mounting variations, in order to achieve the desired acoustic tonality and volume.

Figure 8:
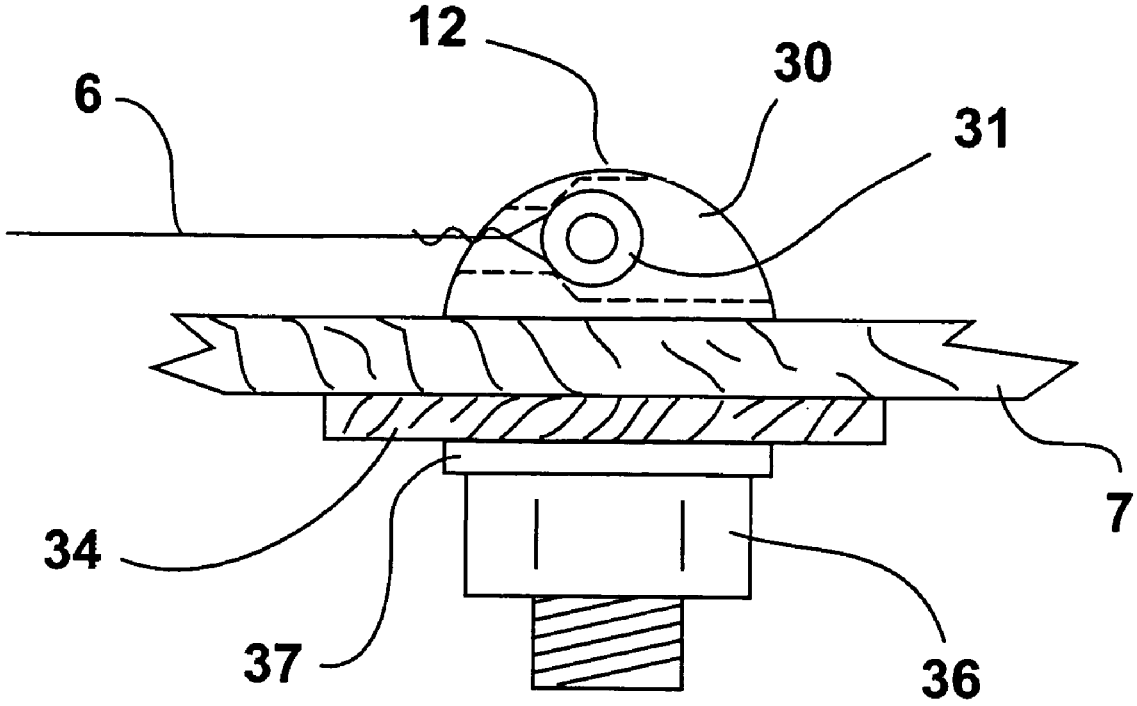
FIG. 8 is a close up side view of a string retainer module.

FIG. 8 illustrates a close up of one variation for the string anchor module. In FIG. 8, the string anchor module has a horizontal hole 30 passing through it that accepts the string 6, yet is small enough to prevent the string ball 31 to pass through it. For ease of string changing, the anchors can be equipped with slots on the top that the string passes through, but traps the ball in position. The string anchor module is attached directly to the soundboard 7 of the guitar body with a thin plate 34 lying underneath to support the string anchor module. The string anchor 12 can be secured in many ways. In the displayed embodiment, the string anchor is secured with a nut 36 and a washer 37.

Figure 9:
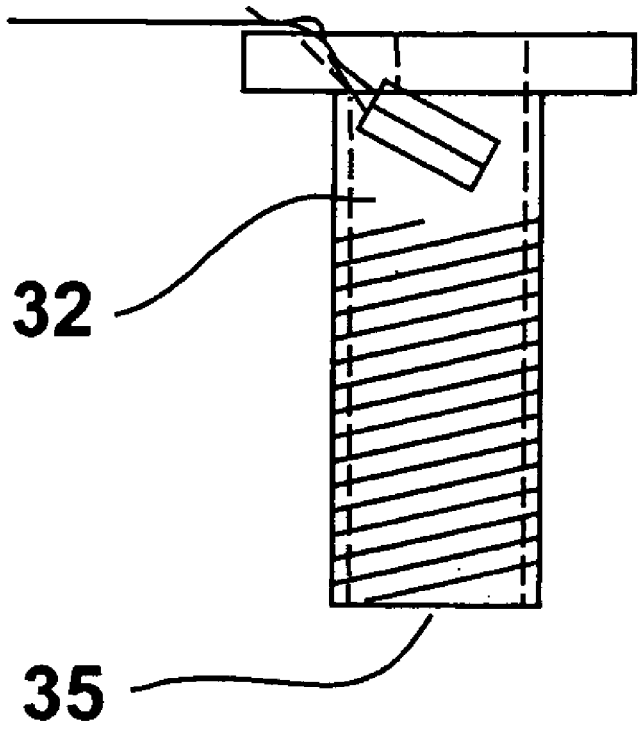
FIG. 9 is a close up side view of a string retainer module.
Figure 10:
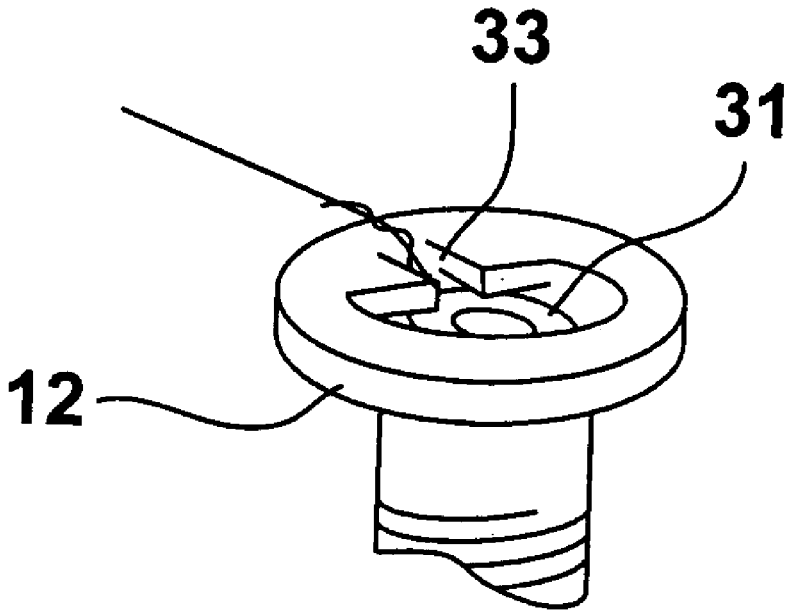
FIG. 10 is a close up top plan view of a string retainer module.

FIGS. 9–10 illustrate another variation of the string anchor module. In this embodiment, the string anchor module 32 has a vertical hole 35 through the string anchor 12 forming a semi tube with a vertical slot 33 to catch the string ball 31.

The invention claimed is:

1. A stringed musical instrument comprising:

a hollow body having a soundboard and soundhole;

a neck mounted to said hollow body;

one or more strings stretched over said hollow body and said neck;

said neck having upper string anchoring means and means for an upper contact point with the string;

a bridge body secured on the soundboard and having thereon a saddle for providing a lower contact point with the string, said bridge body including a string retainer body with said string retainer body having directing means to guide each string from the lower string anchors past said retainer body to the saddle, lower string anchoring means secured to the soundboard wherein one or more of said strings are anchored below the bridge; and, wherein said string retainer body consists of a solid material, and, has a recess extending through said retainer body whereby said recess is contoured to allow the strings to pass through said recess in a desired spacing relative to the other strings and along a desired horizontal plane between the saddle body and the lower anchoring means.

2. A stringed musical instrument comprising:

a hollow body having a soundboard and soundhole;

a neck mounted to said hollow body;

one or more strings stretched over said hollow body and said neck;

said neck having upper string anchoring means and means for an upper contact point with the string;

a bridge body secured on the soundboard and having thereon a saddle for providing a lower contact point with the string; and lower string anchoring means secured to the soundboard wherein one or more of said strings are anchored below the bridge; and, wherein said lower string anchoring means is comprised of an anchoring module: said anchoring module having a solid module body with a lower edge and with a receiving hole on the lower edge of said module body, each string having a string ball, said receiving hole having a diameter larger than the string diameter but smaller than diameter of the ball of the string; and a recess in said anchoring module body to allow said string to pass through said anchoring module body; an outlet hole in said top side of the anchoring module body, said outlet hole allowing the string to extend past said anchoring module body and towards the bridge body.

3. A stringed musical instrument comprising:

a hollow body having a soundboard and soundhole;

a neck mounted to said hollow body;

one or more strings stretched over said hollow body and said neck;

said neck having upper string anchoring means and means for an upper contact point with the string;

a bridge body secured on soundboard and having thereon a saddle for providing a lower contact point with the string;

lower string anchoring means; and, said bridge body including a string retainer body with said string retainer body having directing means to guide each string from the lower string anchoring means past the retainer body to the saddle, and adjustable means for repositioning said bridge body on said soundboard, said adjustable means comprising: adjustable fastening means for securing the bridge body to the bridge plate whereby said fastening means can be readily loosened and tightened; and said bridge plate has recessed slots in a direction parallel to the direction of the strings to accommodate said adjustable fastening means, whereby the bridge body can be adjusted along said recessed slots by loosening said fastening means, repositioning said bridge body up or down said recessed slots, and tightening said fastening means.

4. A stringed musical instrument comprising:

a hollow body having a soundboard and soundhole;

a neck mounted to said hollow body;

one or more strings stretched over said hollow body and said neck;

said neck having upper string anchoring means and means for an upper contact point with the string;

a bridge body secured on soundboard and having thereon a saddle for providing a lower contact point with the string;

lower string anchoring means, said lower string anchoring means being comprised of an anchoring module:

said anchoring module having a solid module body with a lower edge and with a receiving hole on the lower edge of said module body, each string having a string ball, said receiving hole having a diameter larger than the string diameter but smaller than diameter of the ball of the string; and a recess in said anchoring module body to allow said string to pass through said anchoring module body, and, said bridge body including a string retainer body with said string retainer body having directing means to guide each string from the lower string anchoring means past the retainer body to the saddle, and adjustable means for repositioning said bridge body on said soundboard.

5. The musical instrument of claim 1 wherein the lower string anchoring means are arranged on the soundboard in a radial or fan-like pattern.

6. The musical instrument as set forth in claim 1 wherein said lower string anchoring means is comprised of an anchoring module, said anchoring module having a solid module body with a receiving hole on the lower edge of said module body, said receiving hole having a diameter larger than the string diameter, the string having a ball, the receiving hole diameter being smaller than the diameter of the ball of the string; and a recess in said anchoring module body to allow said string to pass through said anchoring module body.

* * * * *